US005588312A

United States Patent [19]

Hashimoto

[11] Patent Number: 5,588,312

[45] Date of Patent: Dec. 31, 1996

[54] DRIVING APPARATUS FOR NEEDLES OF KNITTING MACHINE

[75] Inventor: Seishiro Hashimoto, Ishikawa-ken, Japan

[73] Assignees: Tsudakoma Kogyo Kabushiki Kaisha; Kyowa Denki Kogyo Kabushiki Kaisha, both of Japan

[21] Appl. No.: 569,493

[22] Filed: Dec. 8, 1995

[30] Foreign Application Priority Data

Dec. 14, 1994 [JP] Japan ..... 6-332358

[51] Int. Cl.[6] ..... D04B 15/00

[52] U.S. Cl. ..... 66/75.2; 66/125 R

[58] Field of Search ..... 66/125 R, 215, 66/216, 218, 219, 13, 8, 75.2

[56] References Cited

U.S. PATENT DOCUMENTS

| | | | |
|---|---|---|---|
| 4,768,357 | 9/1988 | Ohtake | 66/75.2 |
| 4,998,420 | 3/1991 | Scavino | 66/125 R X |
| 5,282,371 | 2/1994 | Otsuki | 66/215 X |

FOREIGN PATENT DOCUMENTS

| | | | |
|---|---|---|---|
| 0235987 | 9/1987 | European Pat. Off. | D04B 15/36 |
| 0578166 | 1/1994 | European Pat. Off. | D04B 15/32 |
| 2362631 | 6/1975 | Germany | D04B 15/78 |
| 1-12855 | of 1989 | Japan . | |

*Primary Examiner*—John J. Calvert
*Attorney, Agent, or Firm*—Webb Ziesenheim Bruening Logsdon Orkin & Hanson, P.C.

[57] ABSTRACT

The invention provides a driving apparatus for needle of a knitting machine wherein a coupling operation of a stator assembly and a moving assembly can be facilitated and a smooth movement of the moving assembly is assured. The driving apparatus includes a linear motor for reciprocally moving the needle. The linear motor include a pair of stator assemblies each having first magnet means thereon and opposed to each other with a space left therebetween in the horizontal direction intersecting a vertical direction, a moving assembly having second magnet means and disposed vertically between the stator assemblies so as to move in a direction of movement of the needle, and coupling means for supporting the moving assembly on at least one of the stator assemblies. The coupling means supports the moving assembly on at least one of the stator assemblies at a location either above or below a position at which the second magnet means is arranged. A position sensor detects a position of the moving assembly with respect to the stator assemblies.

7 Claims, 4 Drawing Sheets

DRIVING APPARATUS FOR NEEDLES OF KNITTING MACHINE

BACKGROUND OF THE INVENTION

1. Field of the Invention

This invention relates to a driving apparatus for needles of a knitting machine, and more particularly to a driving apparatus for moving a needle by means of a linear motor.

2. Description of the Related Art

A flat-knitting machine wherein each knitting needle is moved by a thin linear motor of a flat plate-like shape is disclosed, for example, in Japanese Patent Application Publication No. 1-12855. A linear motor for a knitting machine of the type includes a flat plate-like stator assembly, a flat plate-like moving assembly connected to the needle, and a position sensor for detecting the position of the moving assembly with respect to the stator assembly.

The stator assembly and the moving assembly are arranged in parallel to each other so as to cooperatively form a flat plate-like linear motor. The moving assembly is held and guided at upper and lower portions thereof so as to assure a high degree of accuracy in movement thereof by a pair of guides mounted on the stator assembly and elongated in the direction of movement of the moving assembly, and by a pair of bearings mounted on the moving assembly and individually fitted with the guides so as to move in the direction of movement of the moving assembly.

A linear motor of the type described above is assembled, for example, in the following manner. The guides in pair are first assembled into the stator assembly, and the bearings in pair are assembled into the moving assembly. Then, the bearings in pair are assembled into the guides. Thereafter, an operation of adjusting the mounting positions and the mounting condition of the guides on the stator assembly and another operation of adjusting the mounting positions and the mounting condition of the bearings on the moving assembly are performed simultaneously so that the moving assembly may move smoothly relative to the stator assembly and the guides.

The mounting condition of the guides on the stator assembly such as the parallelism and the distance between the guides mounted on the stator assembly and the mounting condition of the bearings on the moving assembly such as the parallelism and the distance between the bearings mounted on the moving assembly have such a relationship that, if one of them is varied, the other must be also varied. Accordingly, the operations described above are complicated and the assembling operations of the guides and the bearings into the stator assembly and the moving assembly are very cumbersome. Therefore, much skill is required for an assembling operation of the linear motor.

Meanwhile, in a knitting machine, the higher the accuracy in position and speed of movement of needles are, the higher the quality of a knit fabric becomes. Therefore, it is desired for a linear motor for a knitting machine to assure enhanced accuracy in position control and speed control of a moving assembly with respect to a stator assembly to allow the moving assembly to move smoothly and accurately over the overall range of movement of it in its direction of movement.

However, in the conventional linear motor for a knitting machine described above, an exciting coil of the stator assembly is disposed on a thin plate member such as a metal plate. Further, magnetic forces generated from the coil arranged on the stator assembly and a permanent magnet arranged on the moving assembly mutually act. From the two reasons just described, the plate member of the stator assembly and a plate member of the moving assembly are deformed when assembling the guides and the bearings into the stator assembly and the moving assembly, respectively, when assembling the moving assembly into the stator assembly and when moving the moving assembly. As a result, the parallelism between the guides or the parallelism between the bearings becomes no longer accurate, making it less easy for the moving assembly to move, thereby disturbing smooth movement of the moving assembly.

Therefore, in the conventional linear motor for a knitting machine, the accuracy in holding and guiding the moving assembly by the pair of guides and bearing is set comparatively low in order to assure smooth reciprocating movement of the moving assembly. In other words, a large play is provided at a coupling portion between the stator assembly and the moving assembly to assure smooth reciprocating movement of the moving assembly.

However, where such a large play is provided at the coupling portion between the guide and the bearing for coupling the stator assembly and the moving assembly, a uniform distance is not assured between the stator assembly and the moving assembly. Consequently, the position of the moving assembly with respect to the stator assembly cannot be detected accurately. As a result, the position and the speed of movement of the moving assembly with respect to the stator assembly cannot be controlled accurately.

SUMMARY OF THE INVENTION

It is an object of the present invention to facilitate a work to couple the stator assembly and the moving assembly and to smooth the movement of the moving assembly.

According to the present invention, there is provided one linear motor for reciprocally moving one knitting needle. The linear motor includes: a pair of stator assemblies opposed to each other with a space left therebetween in a horizontal direction each having first magnet means thereon; a moving assembly having second magnet means and disposed vertically between the stator assemblies so as to move in a direction of movement of the needle; coupling means for supporting the moving assembly on at least one of the stator assemblies at a location either above or below a position at which the second magnet means is arranged; and a position sensor for detecting a position of the moving assembly with respect to the stator assemblies.

In a state where the linear motor is assembled to the knitting machine, the moving assembly is supported on the stator assembly or assemblies at the location either above or below the position where the second magnet means is arranged. Accordingly, the moving assembly need not be coupled with the stator assembly or assemblies at another location either below or above the position where the second magnet means is arranged. Also, when the moving assembly is reciprocated, magnetic forces of about the same strength and perpendicular to the moving direction of the moving assembly act on the moving assembly from both sides thereof by first magnet means of both stator assemblies, so that the forces compensate each other. As a result, magnetic forces which cause the moving assembly to approach the stator assemblies or to separate from each other hardly act on the moving assembly. Further, the position of the moving assembly relative to the stator assemblies is detected by the position sensor.

Consequently, predetermined members of the coupling means can be assembled separately into the stator assembly or assemblies and the moving assembly, and their assembled states can be adjusted separately. As a result, a coupling operation between the stator assembly and the moving assembly or assemblies can be facilitated. Further, smooth movement of the moving assembly is assured without large play at the coupling portion between the stator assembly or assemblies and the moving assembly.

According to the present invention, the moving assembly is disposed vertically between the pair of stator assemblies and is supported on the stator assembly or assemblies at a location either above or below the second magnet means. Consequently, a coupling operation between the stator assembly or assemblies and the moving assembly can be facilitated and smooth movement of the moving assembly is assured.

Preferably, the position sensor is arranged at a location adjacent the coupling means and on the side of the coupled portion of the moving assembly with the stator assembly or assemblies with respect to the position at which the second magnet means is arranged. Thereby, the position of the moving assembly with respect to the stator assemblies is detected at a position near the coupling portion between the stator assembly or assemblies and the moving assembly. This, together with the fact that large play is avoided at the coupling portion between the stator assembly or assemblies and the moving assembly, enhance the accuracy in detecting the position of the moving assembly with respect to the stator assembly.

Preferably, the coupling means includes a linear bearing having a guide arranged on either the moving assembly or one of the stator assemblies and elongated in the moving direction of the moving assembly, and a bearing arranged in either the moving assembly or the one of the stator assemblies and fitted into the guide so as to move relatively in a longitudinal direction of the guide. Thereby, since the linear bearing has rigidity, even if each of the first magnet means is arranged on a thin plate member such as a metal plate, any curve of the plate member has no influence upon the accuracy in coupling between the moving assembly and the stator assembly or assemblies or upon movement of the moving assembly. As a result, smoother movement of the moving assembly is assured, and the position of the moving assembly with respect to the stator assemblies can be detected with a higher degree of accuracy.

Preferably, the moving assembly and the two stator assemblies respectively include a plate-like member on which the magnet means is arranged and are combined so as to cooperatively form a vertical linear motor having a flat plate-like shape. With this arrangement, a large number of such linear motors can be successively arranged in an overlapped state in the direction of their thicknesses.

The position sensor may include a magnet arranged on one of the moving assembly and the stator assembly and elongated in a direction of movement of the moving assembly, the magnet having N poles and S poles arranged alternatively in the longitudinal direction thereof, and a sensing head disposed on the other of the moving assembly and the stator assembly so as to detect the N poles and the S poles of the magnet.

Normally, a number of linear motors are incorporated in a flat-knitting machine. In such a case, preferably the driving apparatus includes a thin motor assembly of a flat plate-like shape with a plurality of such linear motors arranged successively in the vertical direction or direction of movement of the moving assembly. In the knitting machine, a plurality of such driving apparatuses are arranged successively in an overlapping direction in the direction of thickness of the thin motor assembly.

DESCRIPTION OF THE PREFERRED EMBODIMENTS

Figure 1:
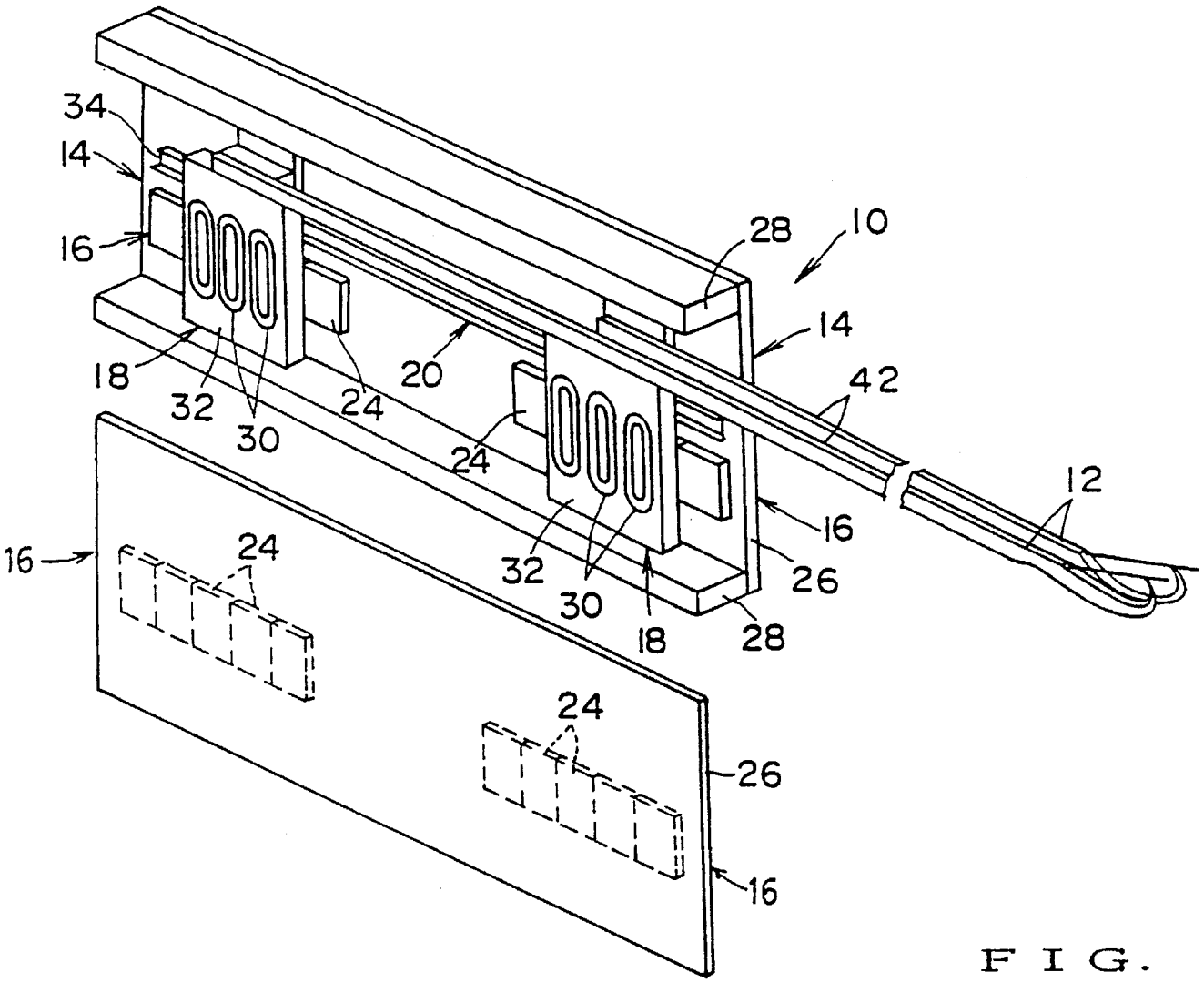
FIG. 1 is a perspective view of a driving apparatus for needles of a knitting machine showing a preferred embodiment of the present invention.
Figure 2:
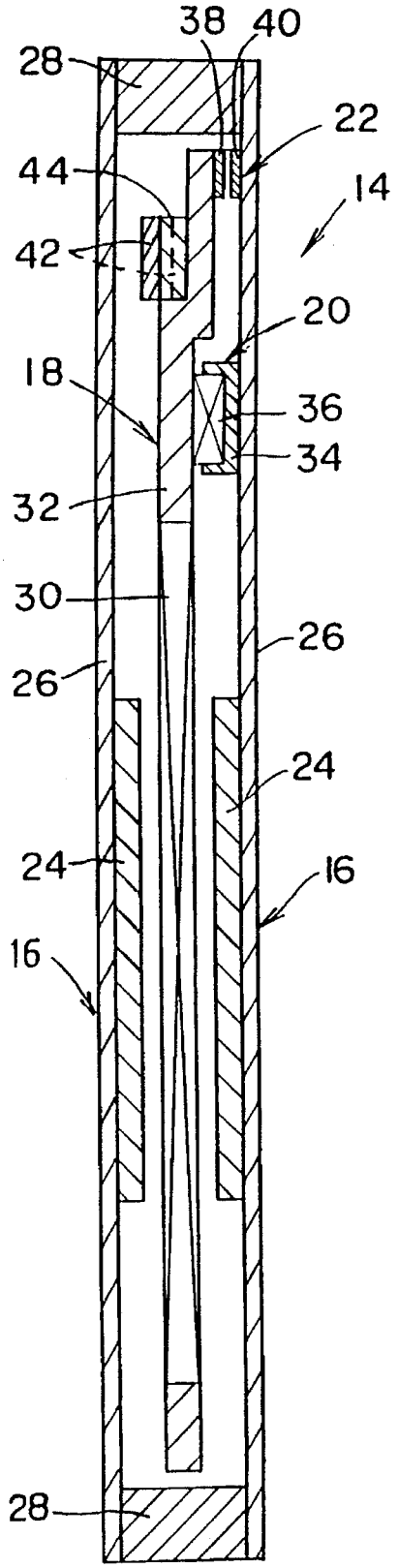
FIG. 2 is a longitudinal sectional view of a linear motor employed in the driving apparatus shown in FIG. 1.
Figure 3:
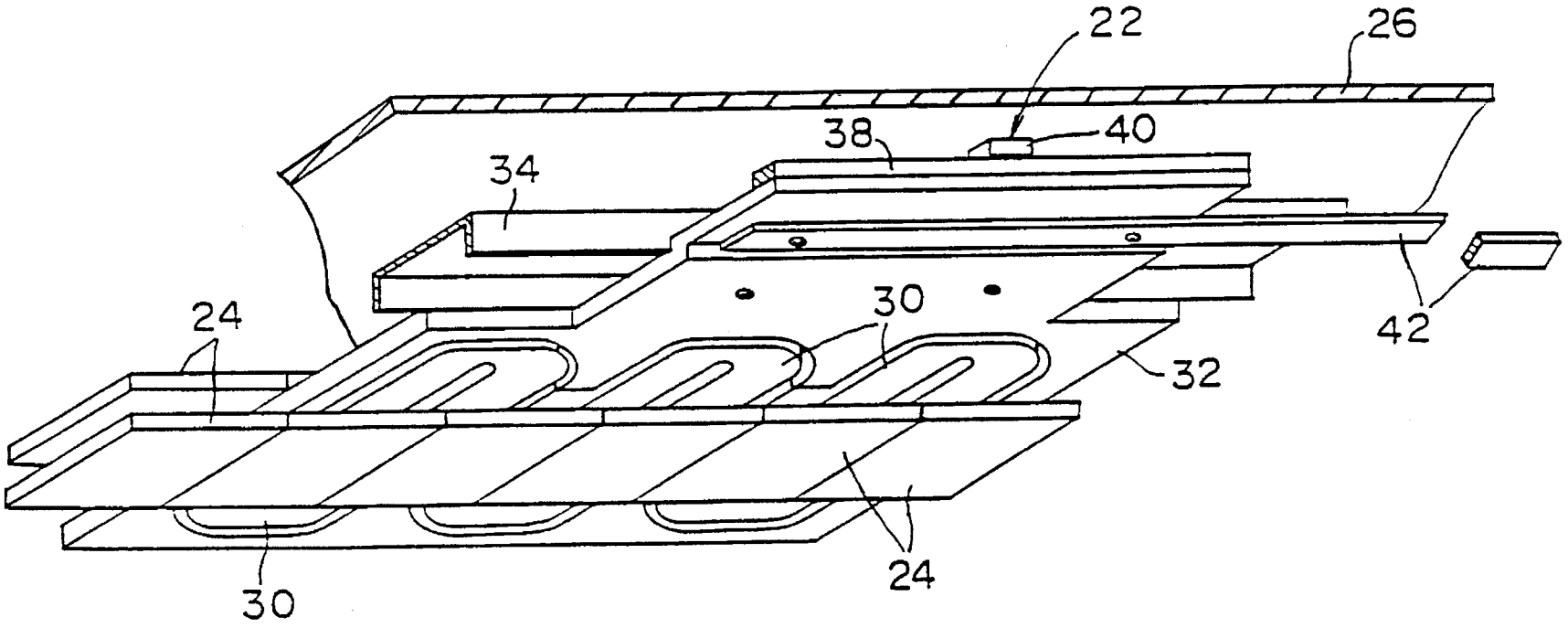
FIG. 3 is a perspective view partly showing, in an enlarged scale, the linear motor shown in FIG. 1.

Referring to FIGS. 1 to 3, a driving apparatus 10 includes a plurality of linear motors 14 each having a flat plate-like shape for reciprocally moving a knitting needle 12 such as a latch needle or a crochet needle for flat-knitting machine. In FIGS. 1 to 3, only two such linear motors are shown. However, since the flat-knitting machine includes a number of needles 12 disposed in parallel to each other on a needle bed, the driving apparatus 10 actually includes the same number of linear motors as that of the needles 12 provided on the flat-knitting machine, preferably the number of the needles to be moved reciprocally by power.

The two linear motors 14 shown are disposed successively in the direction of movement of the needles 12, sharing a part of the stator assembly 16, so that they form a thin motor assembly of a flat plate-like shape. The flat-knitting machine includes a plurality of such motor assemblies arranged in a successively overlapping state in the direction of their thicknesses, that is, in the direction in which the needles are arranged.

Each of the linear motors 14 includes a pair of flat plate-like stator assemblies 16 opposed to each other with a horizontal space left therebetween in a first direction in which the needles 12 are arranged, a flat plate-like moving assembly 18 disposed so as to move between the stator assemblies 16 in a moving direction of the needles 12 (a second direction intersecting the vertical direction and the first direction), a coupling mechanism 20 for supporting the moving assembly 18 movably on one of the stator assemblies 16, and a position sensor 22 (refer to FIGS. 2 and 3) for detecting the position of the moving assembly 18 with respect to the stator assemblies 16.

Each of the stator assemblies 16 includes a plurality of first magnet means 24 disposed successively at a given pitch in the moving direction of the needles 12 (direction of movement of the moving assembly 18) on one of two faces of each of a pair of plate members 26. The first magnet means 24 of the stator assemblies 16 are opposed in a one-to-one corresponding relationship to each other, and the plate members 26 are assembled to each other by means of a pair of spacers 28 and a plurality of screws not shown which extend vertically and in the moving direction of the moving assembly 18. The plate members 26 and the spacers 28 are shared by the two stator assemblies 16.

The moving assembly 18 includes a plurality of second magnet means 30 successively embedded in a plate member 32 in the direction of movement thereof at an arrangement pitch equal to the arrangement pitch of the first magnet means 24. The plate member 32 is disposed between the two stator assemblies 16 so as to extend vertically and in the moving direction of the moving assembly 18 in a plane parallel to the plate members 26 of the stator assemblies 16.

In the arrangement shown, the first magnet means 24 are formed from permanent magnets of about the same size. For the permanent magnets, a magnet having a plate-like shape such as a ferrite magnet, a rare earth metal magnet or a pulverulent magnetic material shaped like a plate together with a synthetic resin material or some other suitable material can be employed. The plate-shaped magnets are magnetized in the direction of their thicknesses such that the magnets apply the same magnetic force to the moving assembly 18. The plate-shaped magnets are arranged on the plate members 26 such that two magnets adjacent the moving direction of the moving assembly 18 have opposite directions of magnetization to each other and such that opposing magnets have the same direction of magnetization.

On the other hand, each of the second magnet means 30 is formed from an exciting coil which is energized in a normal direction and a reverse direction at suitable timings. Further, each of the second magnet means 30 is embedded in the plate member 32 so that the direction of a magnetic field generated by the coil (the direction of a center axis of a coil) may coincide with the direction of thickness of the plate member 32. The opposite end faces of each of the second magnet means 30 may be but need not be exposed to a face of the plate member 32. Further, each of the second magnet means 30 is preferably covered with a synthetic resin made of non-magnetic material.

The plate members 26 are made of a magnetic material such as steel, and the plate member 32 is made of a non-magnetic material such as brass. The spacers 28 may be made of either a magnetic material or a non-magnetic material. When at least a location in the plate member 32 on which the second magnet means 30 is to be arranged is made of a non-magnetic material, the second magnet means 30 may be embedded in the plate member 32 without exposing the opposite end faces thereof to the face of the plate member 32.

Each coupling mechanism 20 is a so-called linear bearing including a guide 34 elongated in the direction of movement of the moving assembly 18 and a bearing 36 fitted into the guide 34 for relative movement in the longitudinal direction of the guide 34. The guide 34 has a channel-shaped cross section and is secured to one of the plate members 26. The bearing 36 has an elongated profile extending along the guide 34 and is secured to the plate member 32. While, in the arrangement shown, the guide 34 is shared by both of the two linear motors 14, one guide 34 may otherwise be provided for each of the two linear motors 14.

The guide 34 is mounted on the one of the plate members 26 by means of a plurality of screws or some other suitable elements such that the open portion thereof is opposed to the moving assembly 18, and that the guide 34 is positioned slightly above the second magnet means 30. In contrast, the bearing 36 is mounted on the plate member 32 such that it is positioned higher than where the second magnet means 30 is arranged on the plate member 32, and such that the first and second magnet means 24 and 30 coincide with each other in their height. To this end, the stator assemblies 16 and the moving assembly 18 are coupled with each other by the coupling means 20 so as to move relative to each other at a location above the first and second magnet means 24 and 30.

Alternatively, the guide 34 of the coupling means 20 may be mounted on the moving assembly 18, while the bearing 36 is mounted on one of the stator assemblies 16. In this instance, one guide 34 is provided for each of the linear motors 14.

The position sensor 22 is a so-called magnet scale including an elongated position detecting magnet 38 disposed on the moving assembly 18 and extending in the direction of movement of the moving assembly 18 and a sensing head 40 arranged on one of the stator assemblies 16.

The position detecting magnet 38 has N poles and S poles arranged alternately in the longitudinal direction thereof. The position detecting magnet 38 is mounted on the plate member 32 by means of a plurality of screws or some other suitable elements so as to be arranged at a position higher than the coupling means 20. The sensing head 40 is mounted on one of the plate members 26 so that, following the movement of the moving assembly 18, it may successively detect the N poles and the S poles of the position detecting magnet 38 and output electric signals corresponding to the N and S poles.

Otherwise, the position sensor 22 may be arranged so as to be positioned between the coupling means 20 and the first and second magnet means 24 and 30. Alternatively, the position detecting magnet 38 of the position sensor 22 may be mounted on one of the plate members 26, while the sensing head 40 is mounted on the plate member 32. In the latter case, one of the position detecting magnets 38 may be elongated and shared by the two linear motors 14.

Each moving assembly 18 is connected to a corresponding one of the needles 12 by means of a jack 42 in the form of an elongated plate or the like. The jack 42 of one of the two moving assemblies 18 is removably assembled at an end portion thereof into the plate member 32 by means of a plurality of screws or other suitable elements. The jack 42 of the other moving assembly 18 is placed at an end portion thereof on a spacer 44. In this state, the other moving assembly is removably assembled into the plate member 32 by means of a plurality of screws or other suitable means.

The thin motor assembly including the linear motors 14 is assembled vertically into the knitting machine such that the direction of movement of the moving assembly 18 forms a predetermined angle with respect to a vertical plane and a horizontal plane, and such that the coupling means 20 and the position sensor 22 are provided higher than the second magnet means 30. Because the moving assembly 18 is supported on the stator assemblies 16 above the second magnet means 30, the moving assembly 18 is not acted upon by any force to displace it toward one of the stator assemblies 16 but is maintained vertical by gravity.

The moving assembly 18 is moved, when a suitable current is supplied to each second magnet means 30, linearly in the moving direction of the needle 12 with respect to the stator assemblies 16 while it is maintained vertical by gravity. In this instance, because the moving assembly 18 is positioned between the stator assemblies 16, the magnetic force acting between the moving assembly 18 and one of the stator assemblies 16 becomes the same as the magnetic force acting between the moving assembly 18 and the other of the stator assemblies 16. Therefore, because the magnetic forces perpendicular to the moving direction of the moving assembly 18 which act on the moving assembly 18 from each of the stator assemblies 16 are opposite to each other, such forces compensate each other and do not displace the moving assembly 18 toward either of the stator assemblies 16.

Because the moving assembly 18 is not displaced toward the one of the stator assemblies 16 due to the gravitational force and the magnetic forces, the moving assembly 18 need not be coupled with the stator assemblies 16 at a location on the other side (in the arrangement shown, on the lower side) with respect to where the second magnet means 30 is located. Therefore, predetermined members of the coupling means 20 can be assembled and adjusted separately into the stator assemblies 16 and the moving assembly 18. As a result, a coupling operation between the stator assemblies 16 and the moving assembly 18 can be facilitated. Further, the moving assembly 18 can be moved smoothly without large play at the coupling portion between the stator assemblies 16 and the moving assembly 18.

As mentioned above, when the moving assembly 18 is supported on the stator assemblies 16 at a location only on one side (in the arrangement shown, on the upper side) with respect to where the second magnet means 30 is located, it is only necessary to assemble the coupling means 20 into the stator assemblies 16 and the moving assembly 18 so that the direction of movement of the moving assembly 18 may be predetermined. Consequently, adjustments in assembling the coupling means 20 are facilitated, and assembly of the stator assemblies 16 and the moving assembly 18 is performed readily. Further, because there is no need for large play at the coupling portion between the stator assemblies 16 and the moving assembly 18, movement of the moving assembly 18 becomes smooth and stabilized.

Movement of the moving assembly 18 with respect to the stator assemblies 16 is detected by the position sensor 22. An enhanced degree of accuracy in detection of the position of the moving assembly 18 with respect to the stator assemblies 16 is achieved due to the advantage described above and due to the fact that the position sensor detects the position of the moving assembly with respect to the stator assemblies at a location adjacent the coupling means 20 with respect to the second magnet means 30.

In the linear motor 14 described above, the moving assembly 18 is supported on one of the plate members 26 using the single guide 34 having a channel-shaped cross section which makes the guide 34 less liable to be deformed than the plate members 26. Therefore, even if the moving assembly 18 is supported firmly by means of the guide 34 and the bearing 36 without large play at the coupling portion between the guide 34 and the bearing 36, the movement of the moving assembly 18 is smooth. Also, because the moving assembly 18 is free on the side thereof opposite to the coupling means 20 with respect to the location of the second magnet apparatus 30, the movement of the moving assembly 18 is smooth. Further, due to the arrangement of the moving assembly 18 described above, the position of the moving assembly 18 with respect to the stator assemblies 16 can be detected with a high degree of accuracy.

Where the first magnet means 24 are formed from permanent magnets and the second magnet means 30 are formed from exciting magnets as in the embodiment described above, the linear motor exerts a high driving force. However, the first magnet means may be formed from exciting coils while the second magnet means are formed from permanent magnets, or exciting coils may be formed for both of the first and second magnet means.

Where the plate members 26, the spacers 28, the guide 34 and the like are shared by two or more linear motors 14, their assembly is facilitated. However, those elements may otherwise be provided for each of the linear motors 14. The coupling position between the stator assemblies 16 and the moving assembly 18 may be set at a position lower than the position of the second magnet means 30 instead of a position higher than the position of the second magnet means 30.

Figure 4:
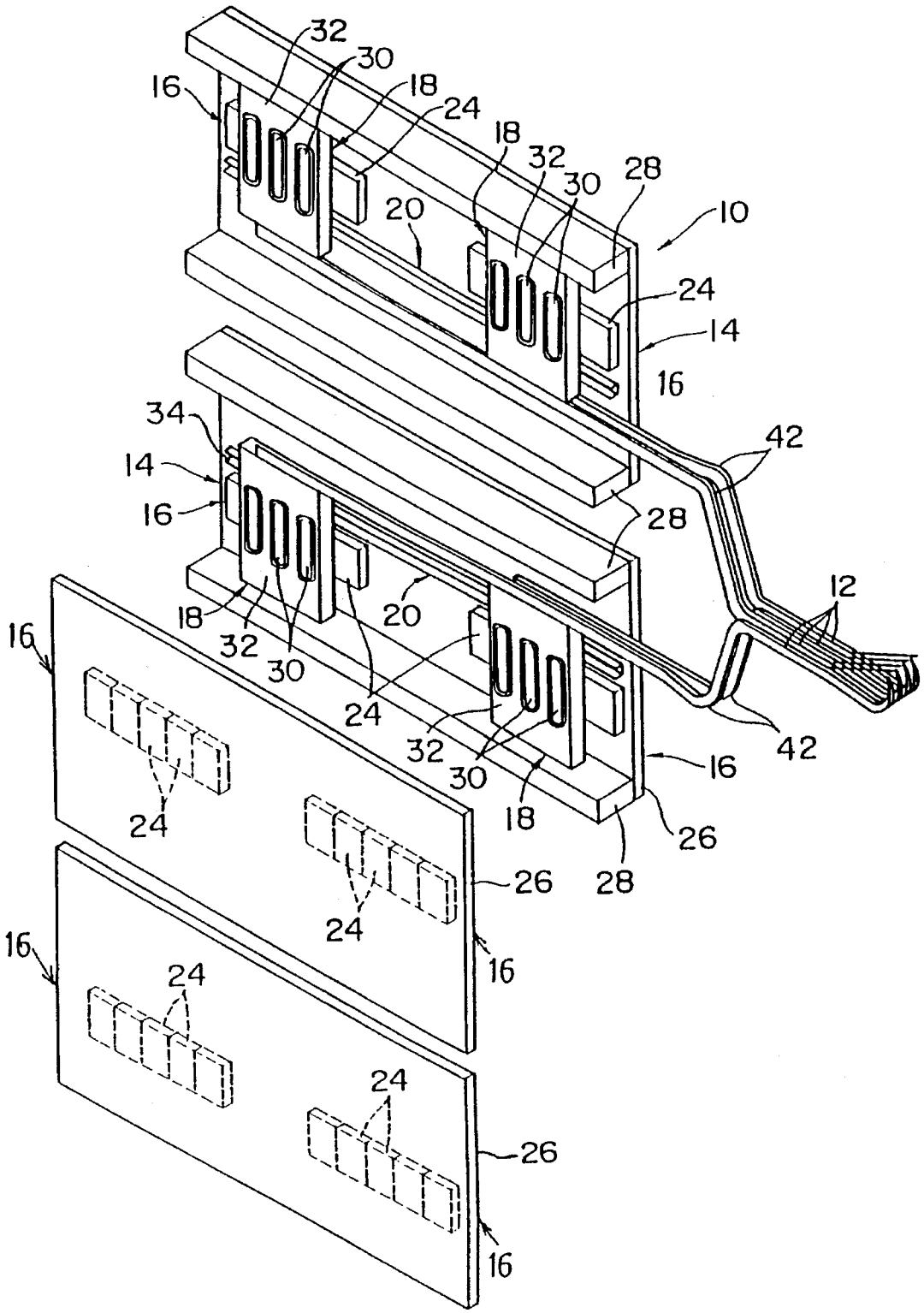
FIG. 4 is a perspective view of another preferred embodiment of the present invention.

As shown in FIG. 4, the driving apparatus may include one or more linear motors 14 with a moving assembly 18 coupled with one of a pair of stator assemblies 16 at a location higher than the position of the second magnet means 30, and another one or more linear motors 14 with a moving assembly 18 coupled with one of a pair of stator assemblies 16 at a location lower than the position of the second magnet means 30.

In the arrangement shown in FIG. 4, the moving assembly 18 of each of the lower side linear motors 14 is coupled, similarly as in the embodiment shown in FIG. 1, with the stator assemblies 16 at a position higher than the position of the second magnet means 30. However, the moving assembly 18 of each of the upper side linear motors 14 is coupled with the stator assemblies 16 at a position lower than the position of the second magnet means 30.

Though not shown in FIG. 4, each of the linear motors 14 also includes a position sensor for detecting the position of the moving assembly 18 with respect to the stator assemblies 16. The position sensor is arranged at a position adjacent to the coupling means 20, that is, on the lower or upper side, with respect to the position of the second magnet means 30.

Each of the linear motors 14 shown in FIG. 4 exhibits similar effects to those of the linear motors 14 shown in FIG. 1 due to the fact that the coupling means 20 thereof employs a guide having a channel-shaped cross section and a bearing coupled to the guide, that the moving assembly 18 has a free end on the side opposite to the coupling means 20 with respect to the position of the second magnet means 30, and that the moving assembly 18 is disposed between a pair of stator assemblies 16.

In each of the embodiments described above, the end of the moving assembly 18 opposite to the coupling means 20 with respect to the position of the second magnet means 30 may be coupled with a stator assembly with large play provided therebetween instead of making it a free end.

What is claimed is:

1. A driving apparatus for needle of a knitting machine, comprising a linear motor for reciprocally moving said needle, said linear motor including:

a pair of stator assemblies opposed to each other with a space left therebetween in the horizontal direction, each of stator assemblies having first magnet means thereon;

a moving assembly having second magnet means and disposed vertically between said stator assemblies so as to move in a direction of movement of the needle;

coupling means for supporting said moving assembly on at least one of said stator assemblies at a location either above or below a position at which said second magnet means is arranged; and a position sensor for detecting a position of said moving assembly with respect to said stator assemblies.

2. A driving apparatus according to claim 1, wherein said position sensor is arranged at a location adjacent to the coupling means and on the side of the coupled portion of said moving assembly with said stator assembly or assemblies with respect to the position at which said second magnet means is arranged.

3. A driving apparatus according to claim 1, wherein said coupling means includes a linear bearing which includes a guide arranged on one of said moving assembly and said stator assembly and elongated in the direction of movement of said moving assembly, and a bearing arranged on the other of said moving assembly and said stator assembly and fitted into said guide so as to move relatively in the longitudinal direction of said guide.

4. A driving apparatus according to claim 1, wherein said moving assembly and said two stator assemblies respectively include a plate-like member on which magnet means is arranged and are combined so as to cooperatively form a vertical linear motor having a flat plate-like shape.

5. A driving apparatus according to claim 1, wherein said position sensor includes a magnet arranged on one of said moving assembly and said stator assembly and elongated in a direction of movement of said moving assembly, said magnet having N poles and S poles arranged alternately in a longitudinal direction thereof, and a sensing head disposed on the other of said moving assembly and said stator assembly so as to detect the N poles and the S poles of said magnet.

6. A driving apparatus according to claim 1, wherein said driving apparatus has a form of a thin motor assembly of a flat plate-like shape by a plurality of such linear motors arranged successively in the vertical direction or the direction of movement of said moving assembly.

7. A driving apparatus according to claim 2, wherein said coupling means includes a linear bearing which includes a guide arranged on one of said moving assembly and said stator assembly and elongated in the direction of movement of said moving assembly, and a bearing arranged on the other of said moving assembly and said stator assembly and fitted into said guide so as to move relatively in the longitudinal direction of said guide.

* * * * *